US006398053B1

(12) United States Patent
Thornsen

(10) Patent No.: US 6,398,053 B1
(45) Date of Patent: Jun. 4, 2002

(54) CONTAINER LINER, COUPLING DEVICE AND A METHOD OF UNLOADING THE LINER

(75) Inventor: Hans Erik Thornsen, Asnæs (DK)

(73) Assignee: Caretex A/S, Helsingor (DK)

( * ) Notice: Subject to any disclaimer, the term of this patent is extended or adjusted under 35 U.S.C. 154(b) by 0 days.

(21) Appl. No.: 09/383,511

(22) Filed: Aug. 26, 1999

(30) Foreign Application Priority Data

Aug. 28, 1998 (DK) ..... 1998 01090
Apr. 14, 1999 (DK) ..... 1998 00488

(51) Int. Cl.[7] ..... B65D 87/00
(52) U.S. Cl. ..... 220/1.6; 601/1.5
(58) Field of Search ..... 220/1.5, 1.6, 601, 220/495.05; 222/105

(56) References Cited

U.S. PATENT DOCUMENTS 3,386,605 A 6/1968 Lafont
4,932,551 A * 6/1990 Thomas et al. ..... 220/1.5
4,961,509 A * 10/1990 Currier ..... 220/1.5 X
5,318,193 A * 6/1994 Podd, Sr. et al. ..... 220/1.5
5,487,485 A * 1/1996 Yang et al. ..... 220/1.5
5,489,037 A * 2/1996 Stopper ..... 220/1.5
5,529,222 A * 6/1996 Toth et al. ..... 220/1.5 X
5,626,254 A 5/1997 Podd et al.
5,975,642 A * 11/1999 Dibble et al. ..... 220/1.5 X

* cited by examiner

*Primary Examiner*—Steven Pollard
(74) *Attorney, Agent, or Firm*—Merchant & Gould P.C.

(57) ABSTRACT

The invention relates to a collapsible container liner comprising side walls defining an interior space said liner having an upper and a lower portion, at least one of said walls (15) comprising an opening communicating with at least one discharge tube (14) being incorporated in the lower portion of said liner, said discharge tube or discharge tubes (14) being fitted with releasable sealing means (114), said sealing means being accessible and releasable from the outside of said discharge tube, said sealing means surrounding and tightening said discharge tube in its closed position, said sealing means providing access to the interior of the liner when released.

Due to the relatively simple technical provisions of the embodiment of the invention, the possibility of utilising a closed-system discharge of a loaded liner is obtained. A simple release of the releasable sealing means blocking the discharge tube provides an opening of the liner, which results in no physical contact with the interior of the container, as the discharge tube communicates with an opening of the interior of the container.

10 Claims, 5 Drawing Sheets

CONTAINER LINER, COUPLING DEVICE AND A METHOD OF UNLOADING THE LINER

BACKGROUND OF THE INVENTION

The present invention relates to cargo container liners , a coupling device as claimed in the dependent claim 7 and an method of unloading a container liner according to the invention.

Standardised containers or boxes extensively used for shipment of freight by land and sea, and the many advantages of such containers have made it extremely desirable to adapt them for use as many types of cargo as possible. Accordingly, there have been attempts, with varying degree of success, to use such standardised containers to carry bulk cargo such as dry bulk chemicals, powdered and pelletised resins, flour, coffee, cocoa and grains or other kinds of granular material.

When cargo containers are used to carry such bulk cargo, it is important that the container itself either be kept clean or be cleaned after each load of cargo is unloaded from the container, so that the container can subsequently be used for another load of cargo. Moreover, it is important to protect the bulk cargo from contamination and from undesirable exposure to the natural elements.

For these reasons, large plastic removable liners are often used to line the interior walls of surfaces in cargo containers that are used to carry bulk cargo. The liners protect the cargo during shipment, and after the container is delivered, the liner can be removed so that the container may be reused to carry other cargo without significant cleaning.

As it may be well understood, such liners are disposable. Consequently, the choice of materials used for the manufacture of the liners is critical with respect to e.g. costs of raw materials, environmental considerations with respect to the choice of raw materials, requirements from the human resources handling such liners in their daily work, etc.

One of the advantages and great potentials of such liners is that extensive hygiene requirements can be met in a simple and very effective way as cleaning can be effected very fast and relatively cheap. Thus, the process may be realised simply by disposing of an old liner and mounting of a new.

A serious drawback of the known liner systems is nevertheless that the great potential of the container lining concept has never been utilised optimally with respect to above mentioned possibilities. This may be acknowledged by a closer examination of the prior art liner concepts which primarily disclose so-called "open" systems with respect to the filling and discharging of such container liners. An "open" system is, according to the terms of the invention, a system wherein the filling or the discharge of the liners requires that the liners has to be opened and exposed to e.g. dirt, dust and other particles from the environment.

So far, the problems related to especially the discharge of the liners have been ignored.

Some attempts have been made to establish "closed" systems addressing the discharge of the liners, as some liner types have been provided with integrated solid discharge tubes which are tailored to specially designed discharge pipe systems. One of the problems related to such containers is very heavy manufacturing costs. Another drawback of such liners is that the connection between the flexible liner and the tube tends to break when the discharging is effected, as the discharge of the liner creates very high stress and pressure levels on the weld seams. It should be noted that the weight of the materials to be unloaded through the discharge pipe might be several tonnes.

Another disadvantage of the above mentioned disposable liners having built-in discharge tubes is that the transport of the unused liners to the customers requires relatively high transport capacity, and, even more importantly, the collection and recycling becomes more complicated. Consequently, a huge unorganised accumulation of such container liners can be found at unloading locations.

OBJECT OF THE INVENTION

A collapsible container liner comprising side walls defines an interior space, said liner having an upper and a lower portion, at least one of said walls comprising an opening communicating with at least one discharge tube being incorporated in the lower portion of said liner, said discharge tube or discharge tubes being fitted with releasable sealing means, said sealing means being accessible and releasable from the outside of said discharge tube, said sealing means surrounding and tightening said discharge tube in its closed position, said sealing means providing access to the interior of the liner when released, a very advantageous container liner has been obtained.

Thus, the relatively simple technical provisions of the embodiment of the invention provide the possibility of utilising a closed-system discharge of a loaded liner. Thus, a simple release of the releasable sealing means blocking the discharge tube provides an opening of the liner, resulting in no physical contact with the interior of the container, as the discharge tube communicates with an opening to the interior of the container. Known discharge tubes are closed in the sense that the prefabricated opening has to be established manually by means of e.g. a knife, and thus implies contact with the interior of the container. Moreover, it should be noted that the opening system method results in a risk of adding dust, dirt etc. from e.g. the aforementioned knife to the unloaded material. This problem has effectively been dealt with due to the provisions of the invention.

A further important aspect of the invention is that the container liner may be incorporated in a very safe and reliable unloading system. This is due to the fact that the necessary strength of the end wall and the discharge tube of the liner may be provided with external support which is only added to the liner during the unloading process.

A further aspect of the invention is that the container liner may be conveniently pre-established by a qualified trained staff in such a way that the possibility of crucial breaking or leaking may not arise.

Said sealing means comprise a clamp or a string, a further advantageous embodiment of the invention has been obtained.

A string may thus be fitted onto the liner during the manufacturing process, and the string may be released and removed in a very simple way.

Said at least one discharge tube is closed by means of a permanent sealing, preferably at least one weld seam, at the outer end of said at least one tube, said sealing being breakable, a further advantageous embodiment of the invention has been achieved.

The use of permanent sealing at the outer end of the discharge tube provides additional security if the releasable sealing should accidentally break or leak during transport. The permanent sealing may easily be removed, e.g. by cutting away the part of the discharge tube being fitted with the sealing before initiating the unload procedure.

A container liner, according to the invention, may conveniently be arranged with the appropriate number of filling tubes. According to a preferred embodiment, the liner further comprises one filling tube and one ventilation tube arranged in the upper portion of the container liner, thus ensuring that the container liner can be operated in an overall loading and unloading closed system A collapsible container liner comprises side walls defining an interior space said liner having an upper and a lower portion, at least one of said walls comprising an opening communicating with at least one discharge tube being incorporated in the lower portion of said liner, at least one of said discharge tubes being closed by means of a permanent sealing, preferably at least one weld seam, at the end portion of said tube(s), said sealing being breakable, a further advantageous embodiment of the invention has been obtained.

The use of permanent sealing at the outer end of the discharge tube provides additional security if the releasable sealing should accidentally break or leak under transport. The permanent sealing may easily be removed, e.g. by cutting away the part of the discharge tube being fitted with the sealing before initiating the unloading procedure.

A container liner, according to the invention, may conveniently be arranged with the appropriate number of filling tubes. According to a preferred embodiment, the liner further comprises one filling tube and one ventilation tube arranged in the upper portion of the container liner, thus ensuring that the container liner can be operated in an overall loading and unloading closed system.

The discharge tube or discharge tubes is/are fitted with releasable sealing means, said sealing means being accessible and releasable from the outside of said discharge tube, said sealing means surrounding and tightening said discharge tube in its closed position, said sealing means providing access to the interior of the liner when released, a further preferred embodiment of the invention has been obtained, as the synergy provides the discharge tube with both an outer permanent sealing and an inner releasable sealing for optimal loading, transport and unloading conditions.

Said sealing means comprise a clamp or a string, the aforementioned advantages having been obtained, a further advantageous embodiment of the invention has been obtained.

A coupling device for a discharge tube of a collapsible liner is fitted in a container, said coupling device having a mounting end adapted for directly or indirectly securing of said container said coupling device further having a receiving end adapted for receiving a discharge pipe, said receiving end defining an opening having a surrounding receiving surface said receiving surface being adapted to secure an end section/portion of a discharge tube between the receiving surface of the coupling device and a corresponding receiving surface of a discharge pipe, when the coupling device is coupled and secured onto said discharge pipe, a very advantageous embodiment of the invention has been obtained.

The coupling device, according to the invention, should be compared to existing system wherein a plate, such as plywood, or complicated mechanical devices supported by the container or incorporated by the container liner itself will have to form a discharge device or support as such. All such known devices have to be arranged within the container or prefabricated with the liner before the container is loaded and do consequently form part of the cargo.

Thus, the fitting of a coupling device, according to the invention, may established after loading of a container liner and just before unloading. This means that no unnecessary cargo has to be transported together with the container.

Moreover, the fitting of the unloading device is established by means of a supporting coupling device to the container itself since purely mechanical couplings are relatively weak.

The mounting end and said receiving end are spaced in such a way that the discharge tube is directly or indirectly accessible between said ends, a further advantageous embodiment has been achieved, as an unhindered access to the discharge tube may be obtained.

This unique detail provides the possibility of a "closed" system connection between the discharge tube of a liner and a discharge pipe, as sealing means, e.g. a simple string tied around the discharge tube of a liner, may be released after a completed coupling between the discharge tube and the discharge pipe. Consequently, the liner may be unloaded without actual external access to the liner and the load of the liner, such as cutting.

The receiving end has an open and closed position, and wherein said opening is formed by the receiving end in said closed position, a further advantageous embodiment has been obtained, as the arranging of the discharge tube in the coupling device may be obtained in a simple efficient way. The opening in the discharge tube may e.g. be formed by a hinged two-part opening, which may be locked into its closed position.

The securing means are adapted to be secured to retention bars fitted in the opening of a container, an further advantageous embodiment of the invention has been achieved. Thus, surprisingly, the retention bars provide the necessary support and strength in order to withstand the pressure on the coupling device due to unloading.

The simple fastening, according to the invention, should be compared to existing system wherein a plate, such as plywood, or complicated mechanical devices form a discharge device or support as such. All such known devices have to be arranged in the container before the container is loaded and thus form part of the cargo.

The said securing means comprise clamps adapted to correspond to at least two retention bars of a container, a further advantageous embodiment has been obtained, as the securing means may be mounted in a simple and user-friendly way. Moreover, the use of simple clamps, which may simply be clamped onto the retention bars, implies that no mechanical modification of the already known retention bars is necessary.

A further aspect is that the retention bars are designed to withstand relatively high pressures. Any modification of existing retention bars would involve a risk of weakening the strength significantly.

The securing means comprise clamps which are adjustably positioned on said frame, a further advantageous embodiment of the invention has been obtained. Thus, the securing means may be positioned relatively to fit exactly to the retention bars of the container, even though the vertical positioning of the retention bars is relatively inaccurate.

Said device comprises securing means adapted to be secured onto at least two protruding members at the end section of the frame of the opening on the container, an advantageous second embodiment of the discharge frame has been obtained, according to the invention. By securing the coupling device to the opening frame of the container, a particularly simple and solid attachment is possible. A coupling device, according to this second preferred embodiment, is particularly easy to mount as no hooking to the retention bars is required. Since the liner is often pressed up against the back side of the retention bars when filled, a hooking member for fastening the coupling device can be difficult to put in place without damaging the liner.

Said protruding members on the container are part of a door locking mechanism, the coupling device can easily be fitted onto a container without any prior adaptation to the opening frame of the container.

The securing means comprise a first and a second mounting bar that are essentially parallel with each other and provided with tightening means for clamping said bars onto the protruding members, a shiftable securing means is provided, making it possible to fit the coupling device to the left, right or central section of the opening without making any adaptations to the container frame or the coupling device. The tightening means are preferably designed as a threaded rod with a wing nut that can be tightened by hand.

The said mounting end comprises a support surface adapted to support the liner wall when the discharge tube is fitted in the coupling device, a preferred embodiment has been achieved. The function of the support surface is quite crucial, as this surface will prevent the breaking of the discharge tube due to the heavy pressures on the end wall of the liner, especially in the area around the discharge tube. According to this embodiment of the invention, the end wall of the liner may be supported by means of a simple and relatively small device, which may be fastened directly or indirectly onto the container without occupying an undue amount of space.

The unloading of a container liner comprises the steps of

- fitting a coupling device, according to the invention, in the door opening of the container,
- removing the permanent sealing of the discharge tube, if any
- mounting the discharge tube of the liner in the coupling device in such a way that the end section/portion is secured between the receiving surface of the coupling device and a corresponding receiving surface of a discharge pipe, when the coupling device is coupled and secured to said discharge pipe,
- releasing the releasable sealing means of the discharge tube, a very efficient and safe method of unloading a container liner has been obtained.

The unloading, according to the invention, implies a complete coupling of the discharge tube to the discharge pipe prior to removing the releasable sealing means, thus ensuring that the unloading may be effected as a closed-system operation. Reduced expenses with respect to the manufacturing also accompany the effective coupling, as rigid built-in discharge tubes have been avoided.

DETAILED DESCRIPTION OF THE INVENTION

Figure 1:
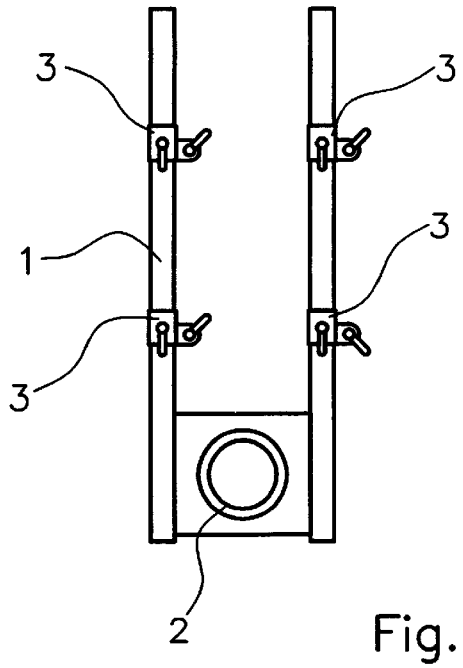
FIG. 1 is a discharge frame according to the first embodiment of the invention.

FIG. 1 shows a discharge frame 1, according to the invention. The discharge frame 1 has clamps 3, which may be positioned conveniently on the frame 1 in order to correspond with the potential, mounting retention bars (not shown) on a container.

The frame 1 supports a discharge opening 2, which will be further described.

Figure 2:
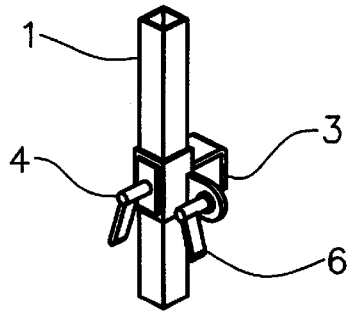
FIG. 2 is a detailed view of the discharge frame of FIG. 1

FIG. 2 is a more detailed view of part of the discharge frame 1 showing that the clamp 3 comprises adjustment means 4 adapted to position and fix the clamp 3 onto the frame 1. Adjustment means 6 are adapted to tighten the clamp 3 and consequently the frame 1 to a corporating retention bar (not shown).

Figure 3:
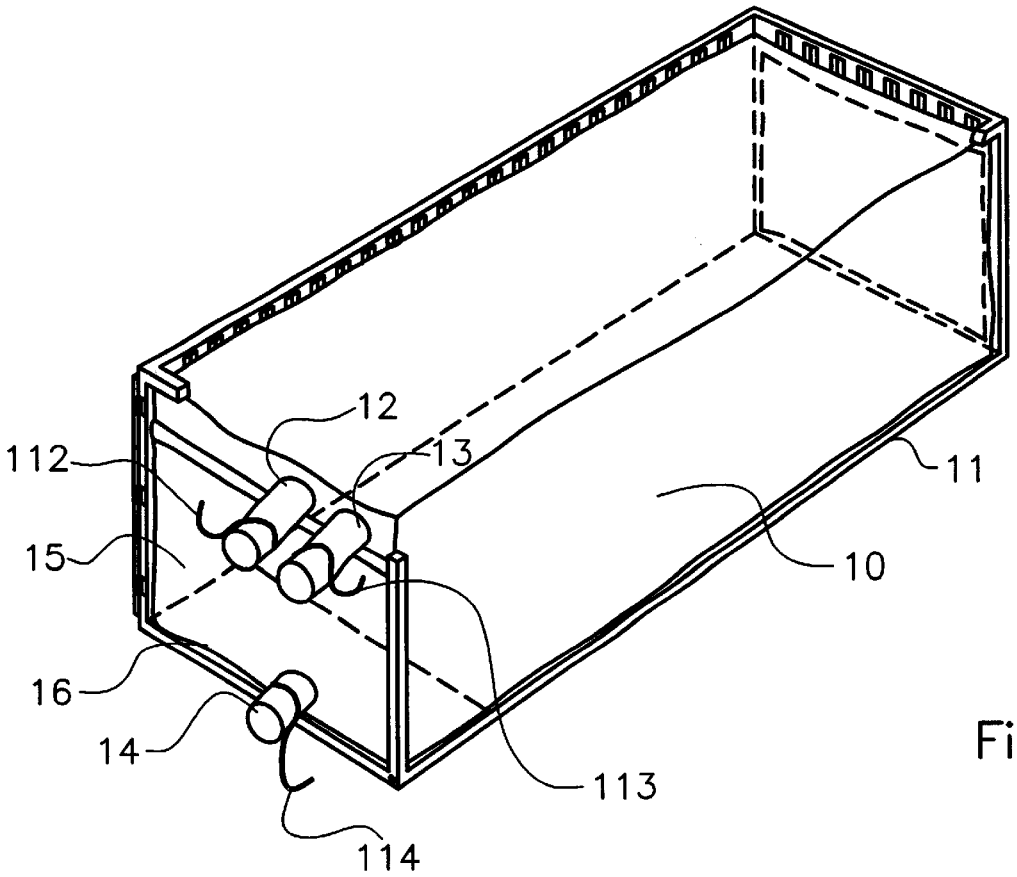
FIG. 3 is an isometric view of a container liner according to the invention.

FIG. 3 is an isometric view of a liner 10 according to the invention.

The liner 10, which is arranged in a standard container 11, has a filling tube 12, a ventilation tube 13 and a discharge tube 14. The tubes are all incorporated in a front wall 15 of the liner 10.

The liner 10 may be loaded through the tube 12 when tube 13 is open or connected to active ventilation means (not shown) in a similar manner. The liner front wall 15 is strengthened by means of an incorporated plastic bulk head 16.

The tubes are sealed by means of releasable strings 112, 113 and 114.

Figure 4:
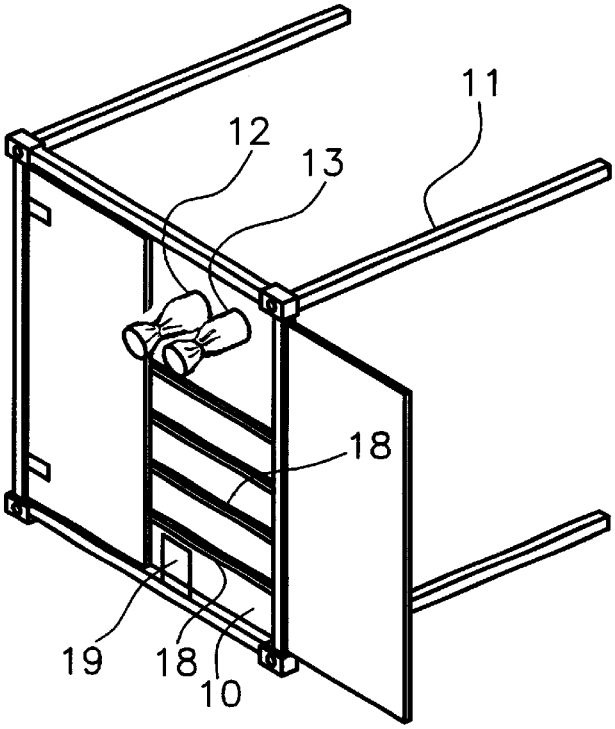
FIGS. 4–10 illustrate the unloading procedure of a liner according to the invention.

FIG. 4 shows the initial steps of a liner 10 being loaded according to the invention.

Before being loaded, the container 11 is provided with retention bars 18. These bars 18 support the liner 10 and the cargo loaded through the tubes 12 and 13 as mentioned above.

A front cover 19 covering the discharge tube 14 is initially removed, and the tube 14 is exposed.

Figure 5:
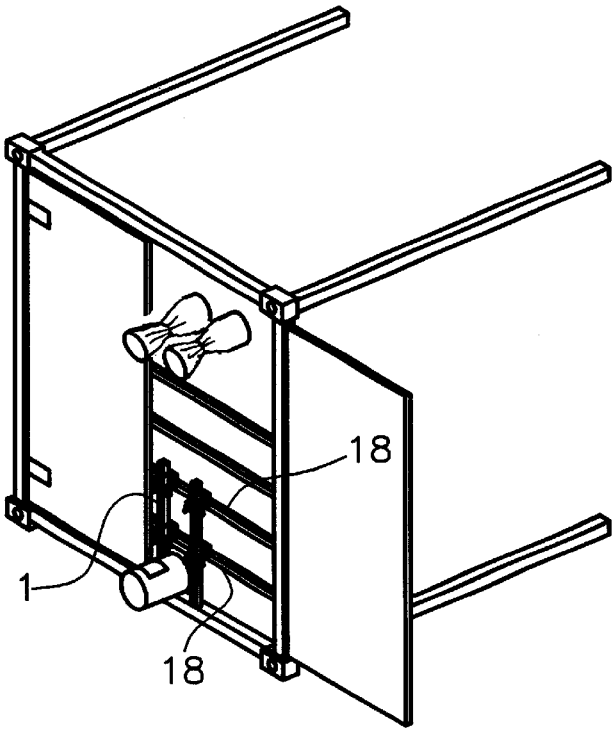

FIG. 5 shows that the discharge frame 1 as showed in FIG. 1 and FIG. 2 is now mounted and fastened onto the retention bars 18. It should be noted that the liner surface around the discharge tube 14 is now solely supported by the container 11 via the retention bars 18 and the discharge frame 1.

Figure 6:
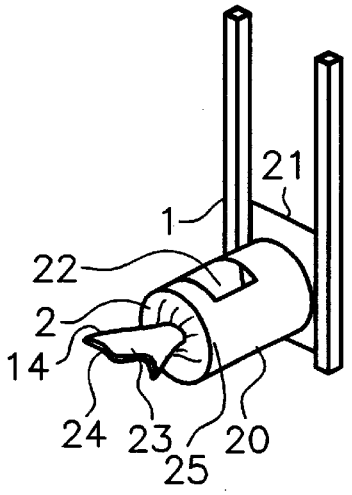

FIG. 6 is a more detailed view of the opening 2 of the frame 1. According to the present embodiment, the opening 2 is formed by a cylinder 20 supported by a support surface 21. The support surface 21 itself is mechanically connected with the frame 1.

It should be noted, that the cross-section of the opening may have other suitable geometrical shapes within the scope of the invention.

The cylinder 20 is provided with a shutter 22, which is hinged to the cylinder 20 and provided with a lock mechanism (not shown). The shutter 22 offers access to the internal of the cylinder 20 between the support surface 21 and the cylinder opening surface at the opposite end 25 of the cylinder 20.

The discharge tube 14 of the liner 10 is positioned in the cylinder 20 in such a way that the outer end 23 of the tube 14 projects out from the cylinder 20. The outer end 23 of the tube 14 is provided with a welded permanent sealing 24.

The support surface 21 provides support to the adjacent liner wall 15. The strong mechanical pressures on the vulnerable liner weld seams will be engaged by this surface 21.

Figure 7:
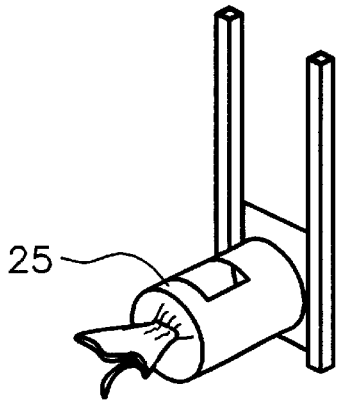

In FIG. 7 the permanent sealing is cut away, thus providing access the inside of the outer end 23 of the tube 14.

Figure 8:
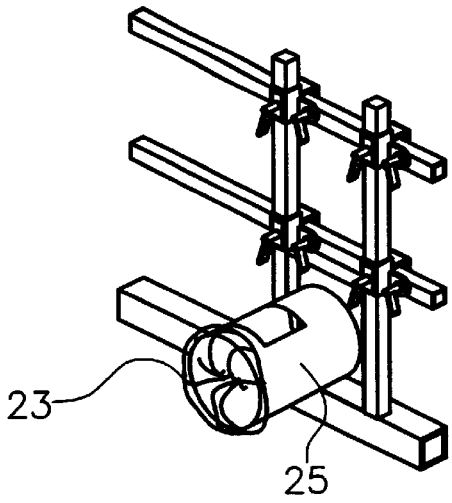

In FIG. 8 the outer end 23 is folded back over the outer end 25 of the cylinder 20

Figure 9:
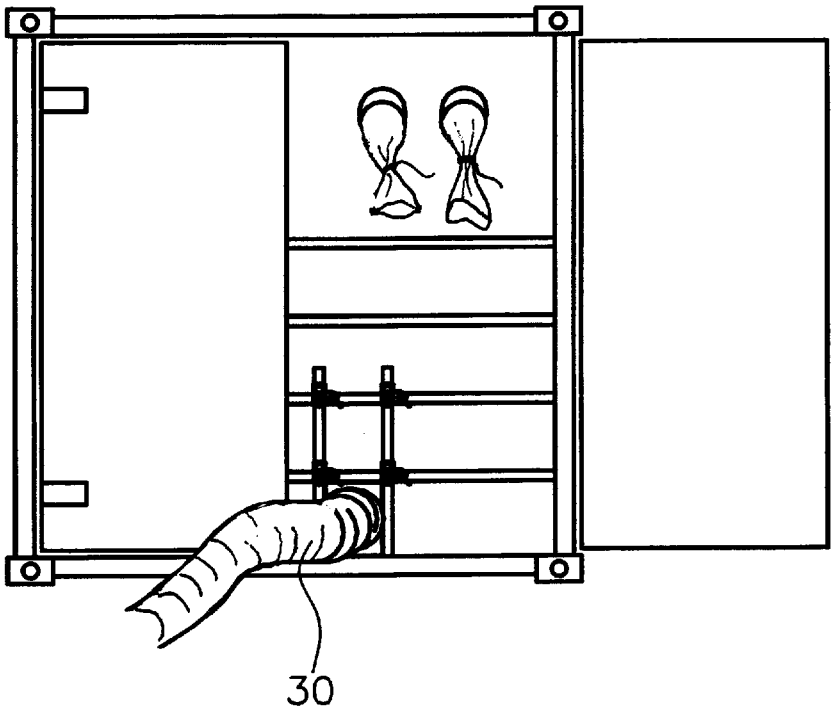

In FIG. 9 a discharge pipe 30 is coupled with the outer end 25 of the cylinder 20, in such a way that the inner surface of the coupling means of the discharge pipe and the outer end 25 grips the outer end 23 of the tube 14.

Thus, the outer end 23 constitutes the sealing between the corresponding receiving surfaces of the cylinder 20 and the discharge pipe 30.

It should be noted that the coupling between the discharge pipe 30 and the opening 2 may be effected in numerous differing mechanical embodiments, as long as the outer end of the liner discharge tube is fixed between corresponding receiving surfaces of the pipe 30 and the cylinder 20.

The receiving surfaces may be appropriately inclined, thus offering an easy coupling. Likewise, the receiving surface of the pipe may be fixed by a receiving surface within the opening of the discharge frame.

Figure 10:
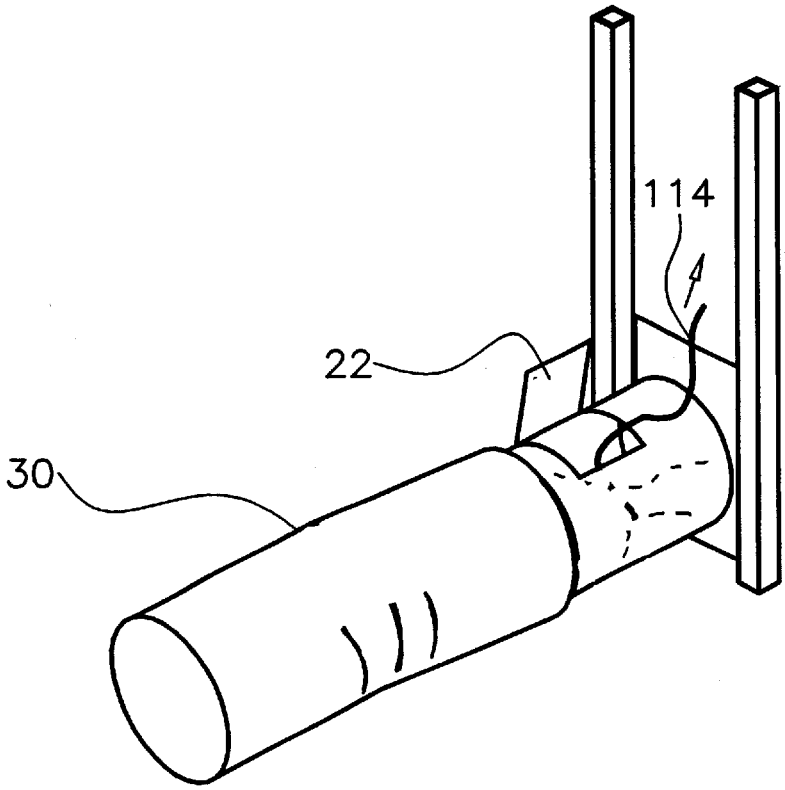

In FIG. 10 the shutter 22 is unlocked and opened, and the releasable string 114 is pulled, thus opening the discharge tube 14. The shutter 22 may now be closed, and the liner can now be unloaded through the discharge pipe 30.

The discharge pipe may conveniently be provided with a discharge valve (not shown) in the proximity of the coupling so that the flow through the pipe is totally controllable.

Figure 11:
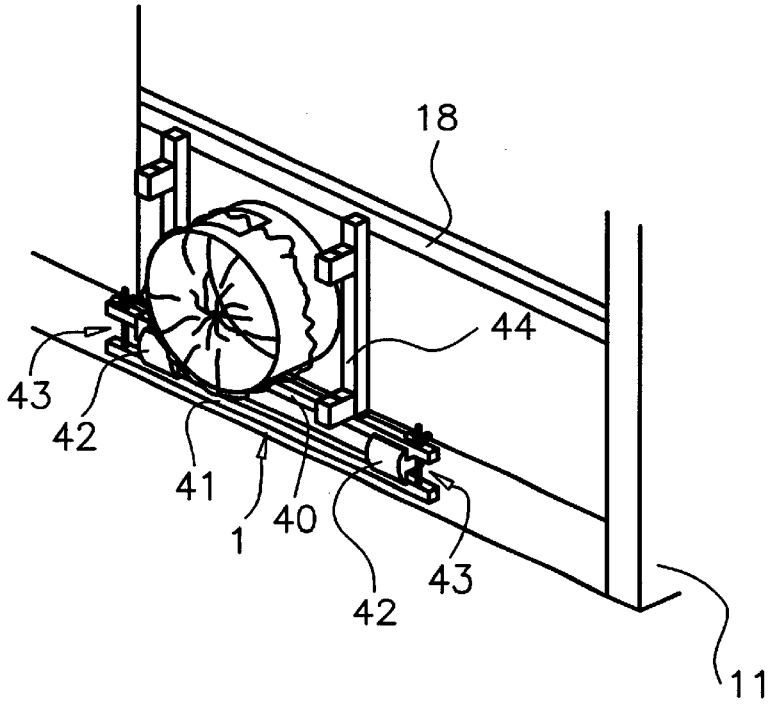
FIGS. 11 and 12 illustrate a second embodiment of a discharge frame according to the invention.
Figure 12:
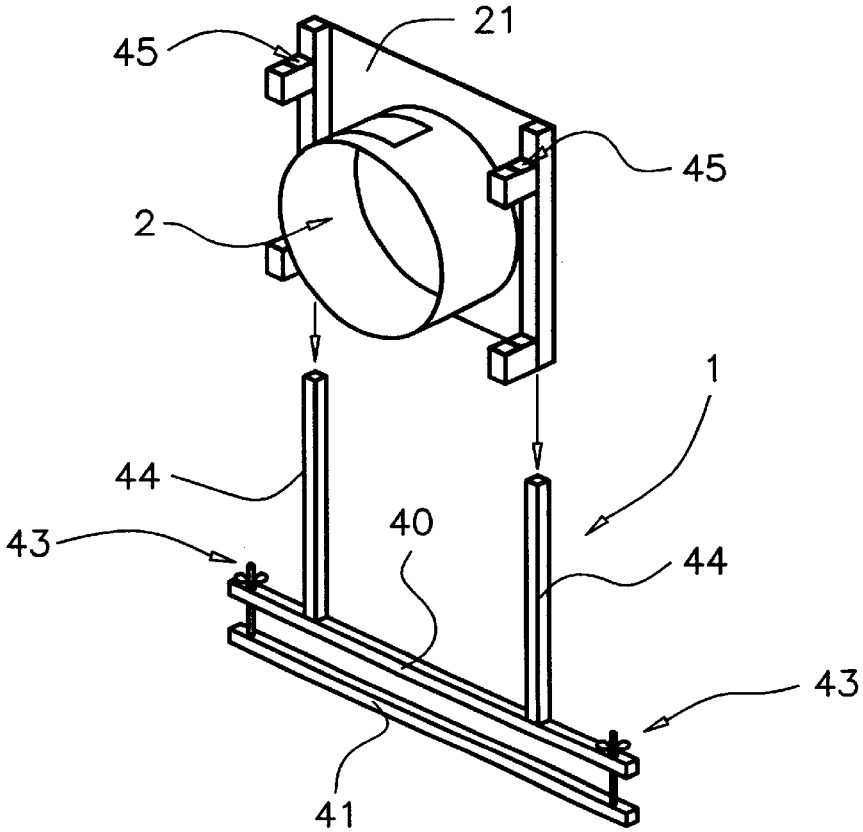

In FIGS. 11 and 12 a second embodiment of a discharge frame 1 is shown, according to the invention. In this embodiment, the discharge frame 1 is adapted to be clamped around protruding members 42 on the floor part of the end frame of the container 11. The protruding members 42 are already present on the container 11, as they are used in the locking mechanism for locking the doors of the container.

The frame comprises two substantively horizontally orientated mounting bars 40 and 41 that are placed on each side of the protruding members 42 and clamped thereto by tightening means 43 that, in a preferred embodiment, are made up by a threaded rod and a wing nut that can be securely tightened by hand.

The first mounting bar 40 is provided with two receiving bars 44 for the receipt of the support surface 21 with the discharge opening 2. The support surface 21 is fitted with a pair of parallel tubular profiles 45 on each side. When mounting the surface 21 on the frame 1, the receiving bars 44 are inserted in the profiles 45.

It should be noted that the coupling between the interior of the liner, i.e. the discharge tube 14, and the discharge pipe 30 can be completed without interference with the interior of the liner.

What is claimed is:

1. Coupling device for receiving a discharge tube of a collapsible liner fitted in a container and connecting said discharge tube to a discharge pipe, said coupling device comprising a tubular member (20) including a mounting end for attaching the coupling device to said container (11), and a receiving end (25) adapted for receiving the discharge pipe (30), said receiving end defining an opening (2) having a surrounding receiving surface, said receiving surface being adapted to secure an end portion of the discharge tube (14) extending through the tubular member (20) and between the receiving surface of the coupling device and a corresponding receiving surface of the discharge pipe (30), when the coupling device is coupled and secured to said discharge pipe (30).

2. Coupling device, according to claim 1, wherein said mounting end and said receiving end (25) are shaped in such a way that the discharge tube is directly or indirectly accessible between said ends.

3. Coupling device for a discharge tube, according to claim 1, wherein said receiving end has an open and closed position, and wherein said opening (2) is formed by the receiving end in said closed position.

4. Coupling device for a discharge tube, according to claim 1, wherein said device comprises securing means adapted to be secured onto retention bars (18) fitted in the opening (2) of a container (11).

5. Coupling device according to claim 4, wherein said securing means comprise clamps (3) adapted to correspond to at least two retention bars (18) fitted in the opening of a container.

6. Coupling device according to claim 1, wherein said securing means comprise clamps (3) which are adjustably positioned on said frame (1).

7. Coupling device for a discharge tube according to claim 1, wherein said device comprise securing means adapted to be secured onto at least two protruding members (42) at the end section of the frame of the opening on the container.

8. Coupling device for a discharge tube, according to claim 7, wherein said protruding members (42) on the container form part of a door locking mechanism.

9. Coupling device for a discharge tube, according to claim 7, wherein the securing means comprise a first and a second mounting bar (40, 41) that are essentially parallel with each other manner and provided with tightening means (43) for clamping said bars (40, 41) onto the protruding members (42).

10. Coupling device for a discharge tube, according to claim 1, wherein said mounting end comprises a support surface (21) adapted to support the liner wall (15) when the discharge tube (14) is fitted in the coupling device (1).

* * * * *